US005169012A

United States Patent [19]

Labrie

[11] Patent Number: 5,169,012

[45] Date of Patent: Dec. 8, 1992

[54] COMBINED WASTE PAPER AND TRASH BASKET

[75] Inventor: Sylvain Labrie, Québec, Canada

[73] Assignee: IPL, Inc., Quebec, Canada

[21] Appl. No.: 831,919

[22] Filed: Feb. 6, 1992

[51] Int. Cl.[5] ..... B65D 21/02

[52] U.S. Cl. ..... 220/23.8; 220/23.86; 220/404; 220/521

[58] Field of Search ..... 220/23.83, 23.86, 521, 220/522, 404, 23.8

[56] References Cited

U.S. PATENT DOCUMENTS

| | | | |
|---|---|---|---|
| 2,759,630 | 8/1956 | Baum et al. | 220/521 |
| 3,414,157 | 12/1968 | Wright | 220/521 |
| 3,446,386 | 5/1969 | Wellington | 220/521 |
| 4,729,489 | 3/1988 | Papaianni | 220/404 |
| 4,860,910 | 8/1989 | Zipper | 220/521 |
| 4,893,722 | 1/1990 | Jones | 220/28.83 |
| 4,905,853 | 3/1990 | Strawder | 220/404 |
| 4,941,653 | 7/1990 | Sterner, Jr. | 220/404 |
| 4,951,831 | 8/1990 | Roesch et al. | 220/404 |
| 4,967,900 | 11/1990 | Gossett | 220/404 |
| 5,022,548 | 6/1991 | Stakis | 220/404 |
| 5,082,132 | 1/1992 | Tsai | 220/23.83 |
| 5,092,480 | 3/1992 | Waterston | 220/23.83 |

*Primary Examiner*—Stephen Marcus
*Assistant Examiner*—S. Castellano
*Attorney, Agent, or Firm*—Longacre & White

[57] ABSTRACT

The disclosure describes a combined waste paper and trash basket which comprises a first body defining a container and a second body supported on this container and consisting of first and second integral parts. The first part defines a non-paper recipient which occupies a portion of the container volume whereby an area thereof is left to receive waste paper. The second part of the second body defines a cover extending over the waste paper receiving area of the container and includes an opening allowing waste paper to be deposited therein.

6 Claims, 4 Drawing Sheets

COMBINED WASTE PAPER AND TRASH BASKET

FIELD OF THE INVENTION

The present invention relates to a combined waste paper and trash basket.

BACKGROUND OF THE INVENTION

Because of the increasing concerns towards ecology and the environment, the recycling of paper has become an important industry in recent years. Efforts to recycle paper are more and more made, particularly in business offices and centres where huge amounts of paper are disposed of daily. Waste paper is usually thrown in a garbage can along with other wastes, such as styrofoam or plastic cups, soft drink cans or bottles, cigarettes butts, etc. Waste paper must therefore be sorted out of the trash, which sometimes the collection an arduous task.

It is known to collect separately waste paper and non-paper material. French Patent No. 2,582,924 (Salvaire) proposes a waste paper basket that has a housing which is divided into two compartments, each of which has an opening at the top. One compartment is intended to receive waste paper while the other receives other wastes.

German Patent Publication No. 39 27 510 (Miller) discloses an insert which can be mounted to the upper edges of a waste paper basket so that waste other than paper can be disposed of therein.

None of the prior art baskets, however, provide a removable cover for the paper receiving recipient, which also contains, integral therewith, a waste receiving body.

The present invention therefore provides a combined waste paper and trash basket that comprises: a first body defining a container and a second body supported on the container and consisting of first and second integral parts. The first part defines a recipient for non-paper waste which has a volume smaller than that of the container so as to leave, in the container, an area to receive waste paper. The second part of the second body defines a cover that extends over the waste paper receiving area. The cover includes means which allow waste paper to be dropped into the waster paper receiving area.

Objects and scope of applicability of the present invention will become apparent from the detailed description given hereinafter. It should be understood that this description, while indicating preferred embodiments of the invention, is given by way of illustration only, since various changes and modifications within the spirit and scope of the invention will become apparent to those skilled in the art.

BRIEF DESCRIPTION OF THE DRAWINGS

For a better understanding of the present invention, reference is made to the following description taken in connection with the accompanying drawings in which.

DESCRIPTION OF PREFERRED EMBODIMENTS

Figure 1:
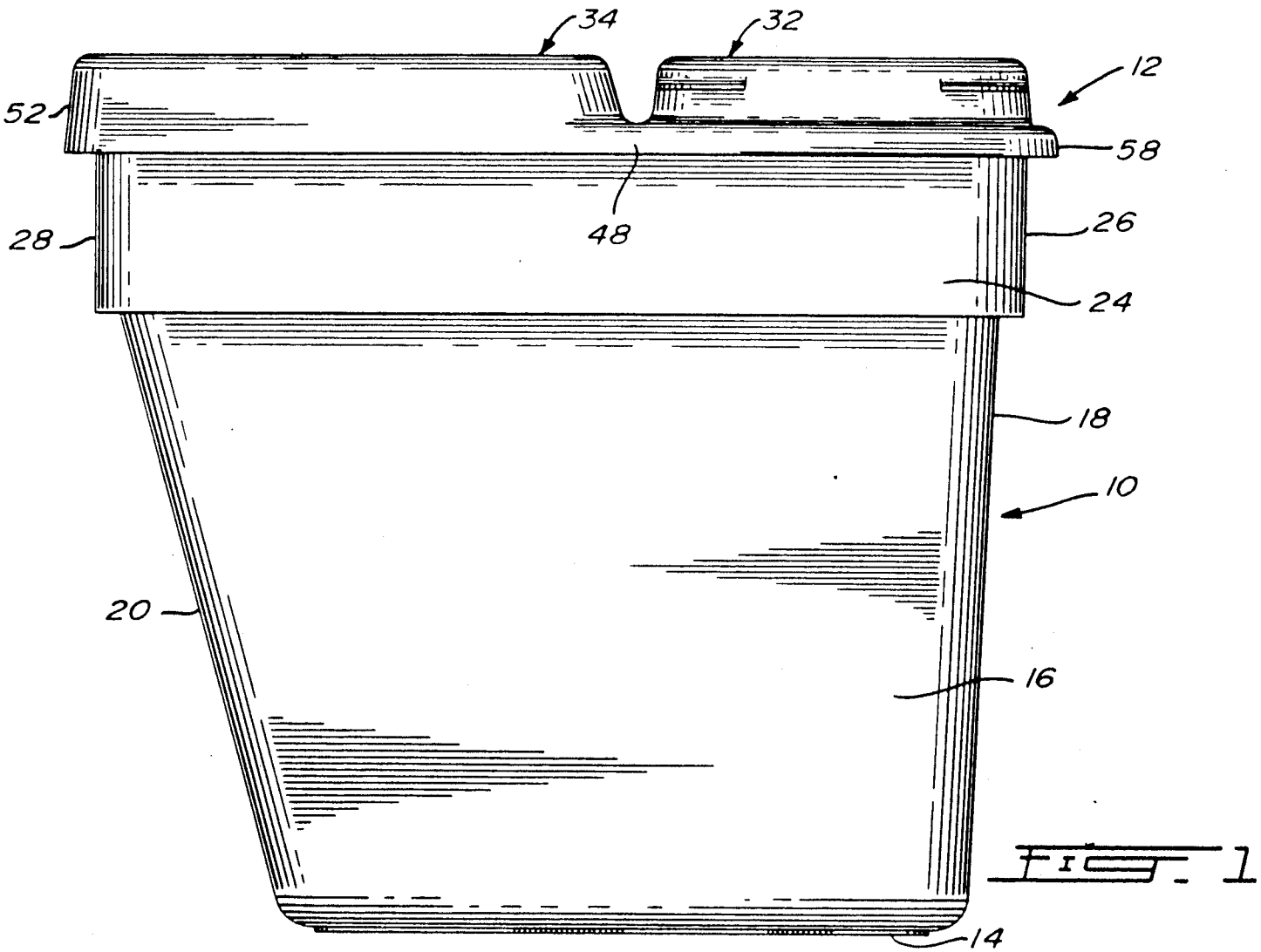
FIG. 1 is a side elevational view of the combined waste paper and trash basket made in accordance with the present invention.

Referring to FIG. 1, there is shown a first body 10 of rectangular shape which supports, at its upper part, a second body 12.

Body 10 defines a container having a bottom wall 14 and four sidewalls 16, 18, 20 and 22. Sidewalls 16, 18 and 22 extend vertically while sidewall 20 is slightly inclined. The upper area of each sidewall displays an outwardly projecting vertical sidewall 24, 26, 28, 30, respectively, each of which has an upper outwardly extending upper edge.

Body 12 has also a rectangular shape to fit over the lower body 10 and includes two integral parts, generally denoted 32 and 34. Part 32 defines a recipient having a bottom wall 36 and four upstanding slightly inclined sidewalls 38, 40, 42 and 44. These walls defines an open compartment having a volume which is considerably less than the volume of the container 10. Hence, he latter is used to receive waste paper while the smaller volume of the recipient serves to receive non-paper waste, usually collected in business offices.

Part 34 of body 12 defines a cover that extends over the paper receiving area of the container 10. An opening 46 is provided in the cover allowing waste paper to be dropped inside the container 10. Preferably, this opening has a shape of an elongated slot that extends over and parallel to the inclined wall 20.

Body 12 has a peripheral skirt defined by four sidewalls 48, 50, 52 and 54 that slightly project beyond the upper peripheral edge of the lower container 10. At various locations under the cover, are provided vertical reinforcing ribs (two of which are shown as 56 and 58) which rest on the upper edge of the container 10. In the recipient part 32, the skirt has an outwardly projecting portion 58 defining a shoulder which rests on the associated upper edge of the container 10.

Figure 3:
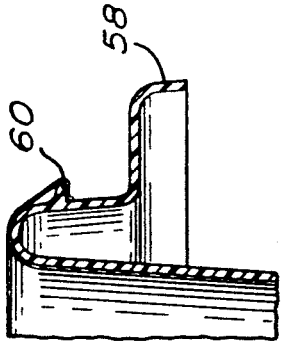
FIG. 3 is a cross-sectional view taken along lines 3—3 of FIG. 2.
Figure 2:
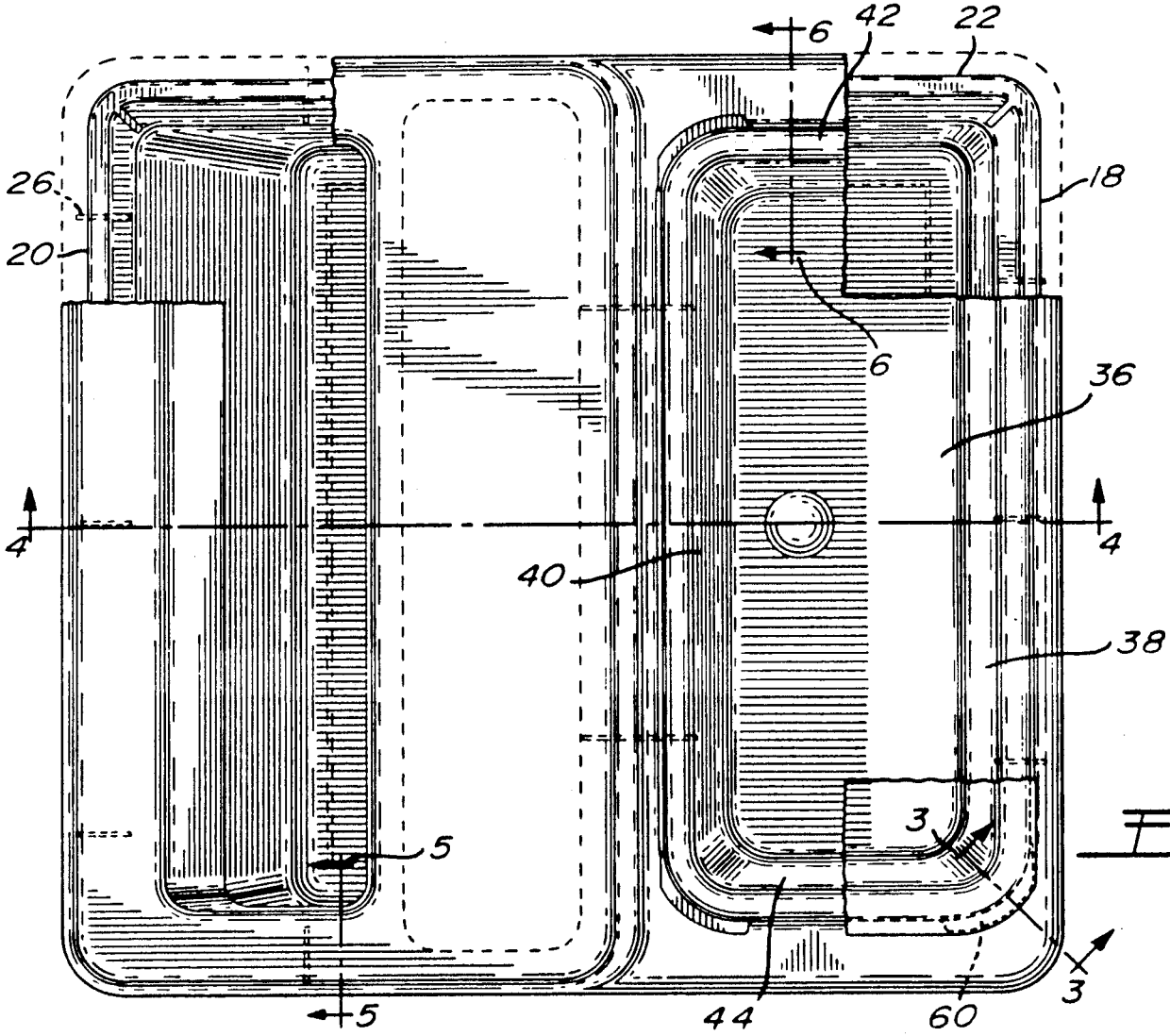
FIG. 2 is a top plan view of the basket shown in FIG. 1.
Figure 4:
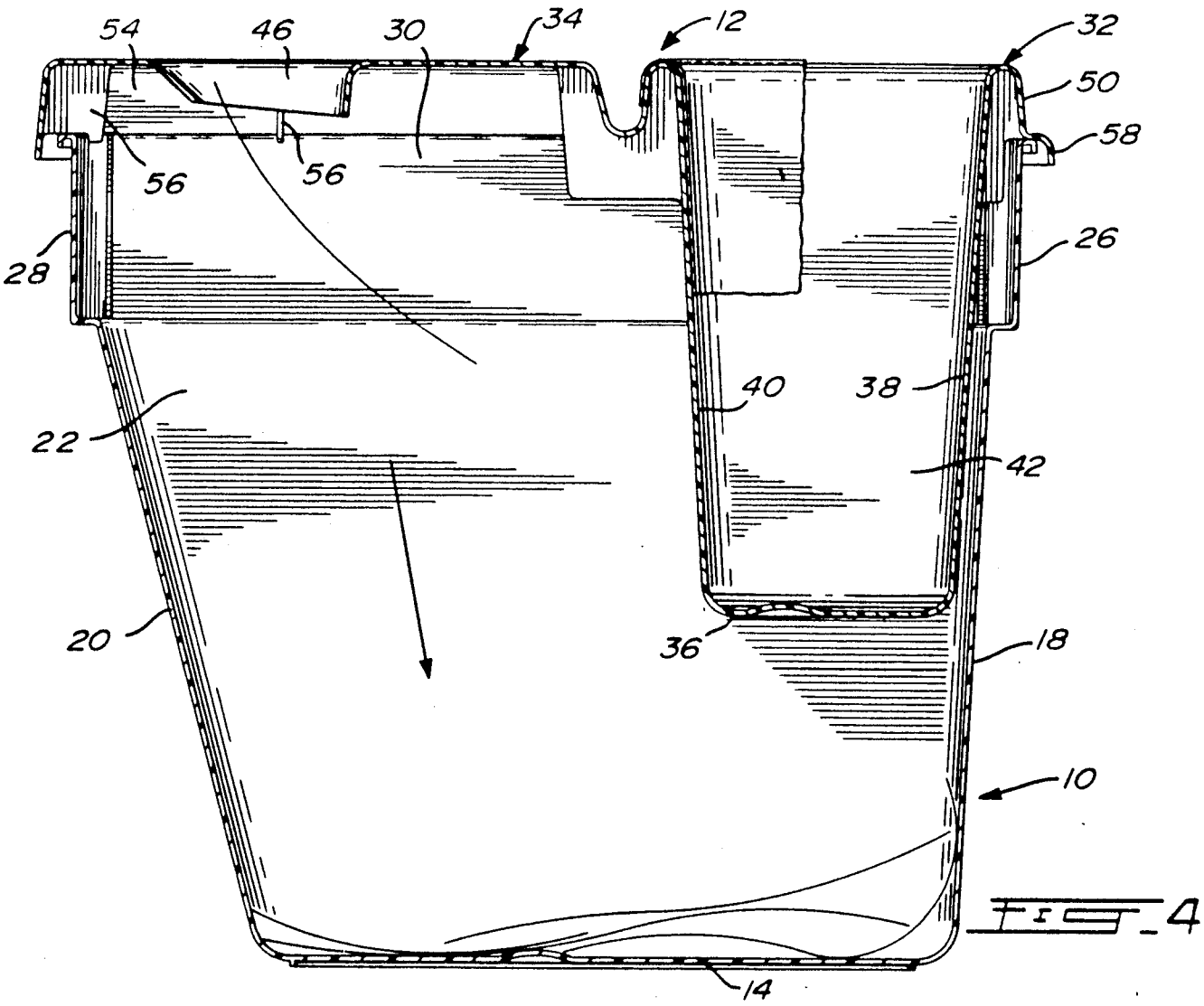
FIG. 4 is a cross-sectional view taken along lines 4—4 of FIG. 2.
Figure 5:
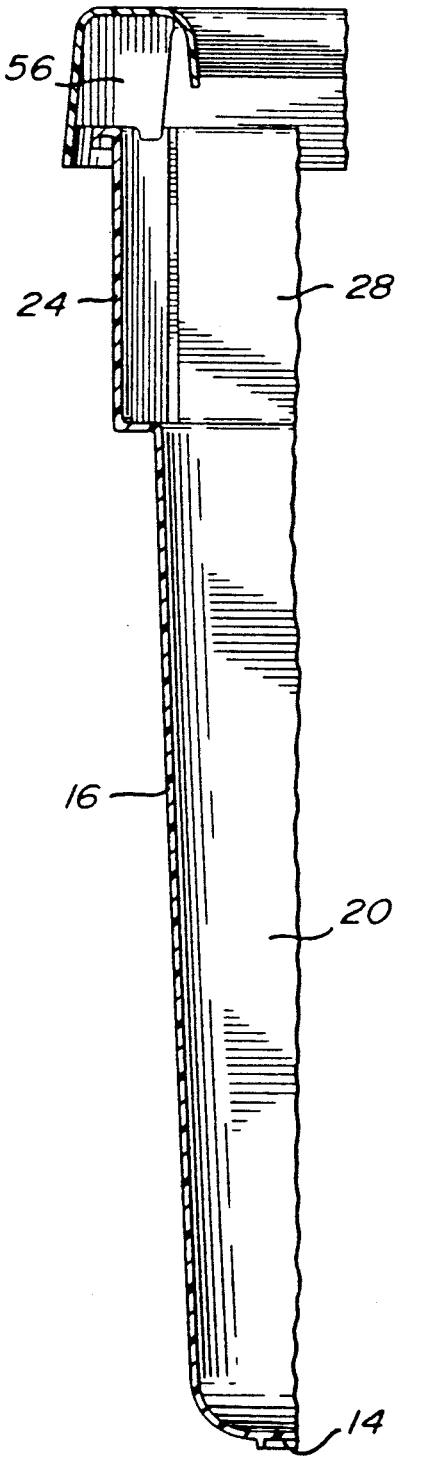
FIG. 5 is a cross-sectional view taken along lines 5—5 of FIG. 2.
Figure 6:
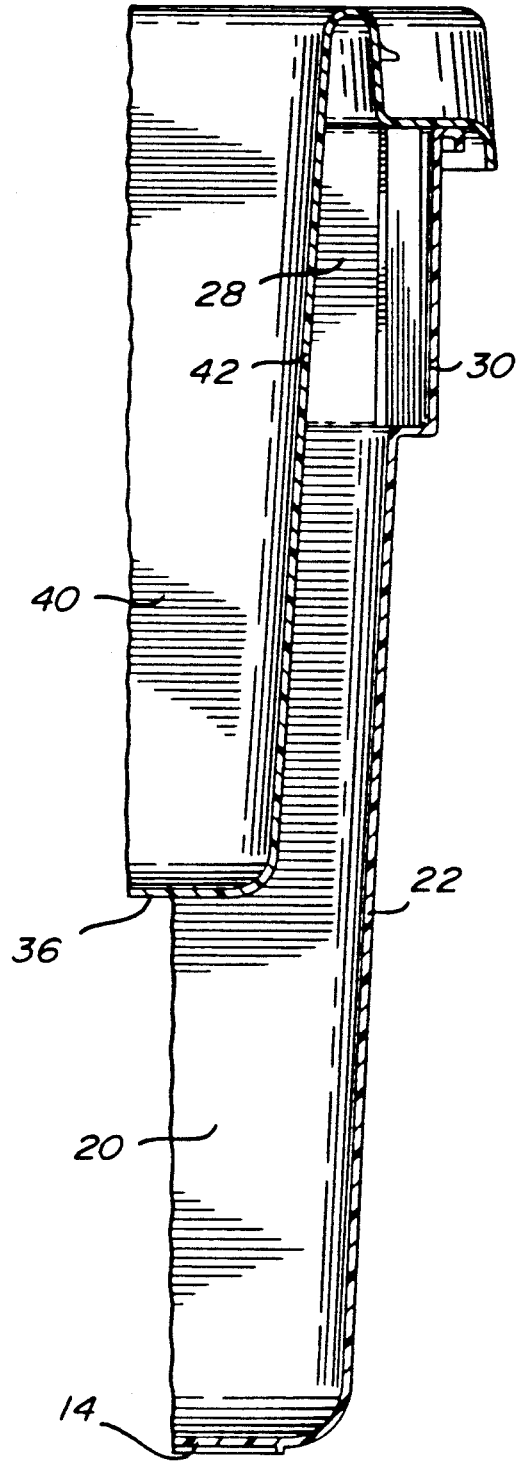
FIG. 6 is a cross-sectional view taken along lines 6—6 of FIG. 2.

As illustrated in FIG. 3, the corner areas of the recipient 32 have a projecting rib 60 so as to allow a plastic bag to be stretchingly engaged therewith and be received within the recipient.

The bodies 10 and 12 are preferrably made of an injection moulded plastic material.

Although the invention has been described above in respect to a specific embodiment of the invention, it will be evident to a person skilled in the art that is may be refined and modified in various ways. For example, a cover could be provided over the recipient 32 of the upper body. It is therefore wished to have understood that the present invention should not limited in interpretation, except by the terms of the following claims.

The embodiments of the invention in which an exclusive property or privilege is claimed are defined as follows:

1. A combined waste paper and trash basket comprising: a first body defining a container having a volume and an entrance into said volume; a removable second body of unitary construction supported on said container and covering entirely the entrance of said container; said second body having first and second integrally formed portions, said first portion defining a recipient for non-paper waste; said recipient being received within said container and occupying a volume smaller than that of said container so as to leave, in said container volume, an area to receive waste paper; said second portion of said second body defining with said first portion a cover extending over said waste paper receiving area; and means, in said second portion, allowing passage of waste paper into said receiving area.

2. A basket as defined in claim 1, wherein said means in said second portion is a slotted opening.

3. A basket as defined in claim 2, wherein said container has a bottom wall and four sidewalls; and wherein one of said sidewalls extend under said slotted opening and is inclined.

4. A basket as defined in claim 1, wherein said second body has a peripheral inverted flange adapted to rest on a peripheral edge of said container.

5. A basket as defined in claim 1, wherein an upper edge of said non-paper recipient includes bag retaining means thereon.

6. A basket as defined in claim 1, wherein said first and second bodies are made of injection moulded plastic material.

* * * * *